US006811102B2

(12) United States Patent
Krause et al.

(10) Patent No.: US 6,811,102 B2
(45) Date of Patent: Nov. 2, 2004

(54) SEALING MEANS AND A RETAINING ELEMENT FOR A FUEL-INJECTION VALVE

(75) Inventors: Heinz-Martin Krause, Markgroeningen (DE); Stefan Lauter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 232 days.

(21) Appl. No.: 10/048,671

(22) PCT Filed: May 31, 2001

(86) PCT No.: PCT/DE01/02061

§ 371 (c)(1),
(2), (4) Date: Jun. 7, 2002

(87) PCT Pub. No.: WO01/94776

PCT Pub. Date: Dec. 13, 2001

(65) Prior Publication Data

US 2002/0162538 A1 Nov. 7, 2002

(30) Foreign Application Priority Data

Jun. 3, 2000 (DE) ..... 100 27 662

(51) Int. Cl.[7] ..... F02M 47/02; F02M 59/00; F02M 39/00

(52) U.S. Cl. ..... 239/533.2; 239/533.3; 239/585.5; 239/88

(58) Field of Search ..... 239/533.2, 533.3, 239/533.7, 533.8, 533.9, 533.12, 585.1–585.5, 88–93; 251/129.15, 129.21; 29/890.124, 890.127

(56) References Cited

U.S. PATENT DOCUMENTS 5,417,373 A * 5/1995 Facchin ..... 239/585.3
5,544,816 A * 8/1996 Nally et al. ..... 239/585.5
5,692,723 A * 12/1997 Baxter et al. ..... 251/129.21
6,003,792 A 12/1999 Munezane et al.
6,045,116 A * 4/2000 Willke et al. ..... 251/129.21

FOREIGN PATENT DOCUMENTS

| | | |
|---|---|---|
| DE | 42 40 514 | 6/1994 |
| DE | 197 35 665 | 1/1999 |
| DE | 197 43 103 | 4/1999 |
| JP | 8-312503 | 11/1996 |
| JP | 11-210886 | 8/1999 |

OTHER PUBLICATIONS

Patent Abstracts of Japan, vol. 1999, No. 13, Nov. 30, 1999*.

* cited by examiner

*Primary Examiner*—Davis Hwu
(74) *Attorney, Agent, or Firm*—Kenyon & Kenyon

(57) ABSTRACT

A sealing element (2) for a fuel injector (1) insertable into a receiving bore (3) of a cylinder head (4) of an internal combustion engine for direct injection of fuel into a combustion chamber (7) of the internal combustion engine has a sealing element (17) surrounding a nozzle body (5) of the fuel injector (1) peripherally. The sealing element (2) includes a base body (15) having an axial recess (16) through which the nozzle body (5) extends. The base body (15) also has an annular recess (18) which communicates with the recess (16) and into which the sealing element (17) is introduced. At a first contact face (51), the base body (15) is in at least indirect contact with an end face (58) of the fuel injector (1), and at a second contact face (57) opposite the first contact face (51), the base body (15) is at least in indirect contact with the step (11) of the receiving bore (3).

21 Claims, 5 Drawing Sheets

SEALING MEANS AND A RETAINING ELEMENT FOR A FUEL-INJECTION VALVE

FIELD OF THE INVENTION

The present invention relates to a sealing element and a holding-down clamp.

BACKGROUND INFORMATION

German Published Patent Application No. 197 35 665 describes a sealing element. The sealing element is formed by a peripheral radial groove provided on a nozzle body of a fuel injector inserted into a receiving bore and a sealing ring inserted into the groove. The sealing ring is prestressed in the radial direction and is supported in the groove of the nozzle body as well as on the wall of the receiving bore.

One disadvantage of the sealing element described in German Published Patent Application No. 197 35 665 is that the prestress on the sealing element depends on the geometry and in particular on the diameter of the receiving bore. Therefore, the conventional sealing element cannot be used universally but instead must be adapted specifically for each receiving bore. In addition, the prestress on the sealing element cannot be adjusted, so the prestress varies due to aging or due to manufacturing tolerances and thus the seal may not be adequate. In addition, the seal is exposed directly to the hot exhaust gases, which results in accelerated aging of the sealing ring. In addition, with the conventional sealing element, penetration of the sealing element may occur in particular because of the almost circular cross section of the sealing element.

Another disadvantage is that due to the radial prestress on the sealing element, there is a frictional force which counteracts an axial displacement of the sealing element. This greatly interferes with both installation and removal as well as adjustment of the fuel injector. Because of soiling deposits on the sealing element and aging of the sealing element, it may even be no longer possible to remove the fuel injector, or the sealing element may be destroyed during removal of the fuel injector.

German Published Patent Application No. 197 43 103 describes a sealing element designed as a thermal insulation sleeve. The thermal insulation sleeve is inserted into a stepped receiving bore of a cylinder head of an internal combustion engine and surrounds peripherally a nozzle body on the spray end of a fuel injector inserted into the receiving bore. The tubular thermal insulation sleeve is bent on the spray end to form a double layer of the sleeve. The double layer of the sleeve is under prestress radially against the wall of the receiving bore to seal the annular gap formed between the nozzle body and the receiving bore. To produce this prestress, the nozzle body of the fuel injector has a conical section which is inserted into the sleeve and is jammed in the sleeve in the area of the bent portion of the sleeve. The fuel injector is also in contact with an inclined step to secure the position of the fuel injector in the receiving bore.

One disadvantage of the fuel injector described in German Published Patent Application No. 197 43 103 is that the thermal insulation sleeve is prestressed in the area of the double layer of the sleeve between the nozzle body and the receiving bore. This results in the problems mentioned above when installing or removing the fuel injector. Another disadvantage is that the position of the fuel injector and the receiving bore is fixedly predetermined. Because of manufacturing tolerances, the axis of the fuel injector introduced into the receiving bore does not in general exactly match the axis of a connection piece of a high-pressure fuel line. Therefore, an additional adaptor is necessary for connecting the fuel injector to the high-pressure fuel line. Japanese Published Patent Application No. 8-312503 describes a holding-down clamp. This holding-down clamp holds a fuel injector down against a relatively high combustion pressure prevailing in the combustion chamber of the internal combustion engine. The holding-down clamp acts on a collar of the fuel injector at two diametrically opposed locations, the lower side of the collar being in contact with the upper side of the cylinder head, so that the fuel injector is secured.

The holding-down clamp described in Japanese Published Patent Application No. 8-312503 has the disadvantage that it acts on the fuel injector only in the axial direction. In the case of a mechanical load on the fuel injector, the fuel injector may therefore be twisted, tilted or displaced in the radial direction. The fuel injector may therefore become loosened at the point of connection and the high-pressure fuel line may be displaced. In addition, there may be an unwanted load on the sealing element. In the case of a sealing element designed as a sealing ring which is in contact with both the fuel injector and the wall of the receiving bore, shearing stresses build up peripherally during rotation of the fuel injector in the sealing ring, thus worsening the sealing properties of the sealing ring.

German Published Patent Application No. 197 35 665 also describes a holding-down device designed as a tension claw like the holding-down clamp described in Japanese Published Patent Application No. 8-312503. In the case of German Published Patent Application No. 197 35 665, the cylinder head has a recess in which the collar of the fuel injector is situated, so the collar of the fuel injector on which the holding-down device acts is lowered into the cylinder head. The disadvantages described above also apply to this holding-down clamp.

SUMMARY

A sealing element according to the present invention may provide the advantage that the fuel injector may be installed into and removed from the cylinder head with no problem, because the sealing element is not under any prestress in the radial direction against the wall of the receiving bore of the cylinder head, so that the sealing element does not interfere with installation and removal. In particular, special tools are thus no longer necessary for installing and removing the fuel injector.

Another advantage may be that the prestress on the sealing element may be predetermined, thus lowering the demands regarding production accuracy. In addition, a fuel injector having the sealing element according to the present invention may be used universally.

The sealing properties of the sealing element may be independent of the location of the fuel injector and the receiving bore so that it is possible to compensate for an axial offset, for example, with no problem.

A holding-down clamp according to the present invention may provide the advantage that the position of the fuel injector and in particular the rotational position of the fuel injector are secured. In addition, the holding-down clamp also acts on the fuel injector in a manner that is at least approximately uniformly distributed around the circumference, so that tilting of the fuel injector is prevented.

The axial height of the recess may be at least essentially equal to half the axial height of the base body of the sealing element. This results in a good sealing effect and a good stability of the sealing element. In addition, it is possible for a radial prestress on the sealing element to act on the nozzle body over a large area.

The radial width of the recess may be at least essentially equal to half the radial width of the cross section of the base body in the area of the recess. This makes it possible to achieve a high elasticity of the sealing element, which is provided by the sealing element, together with a high stability of the sealing element, which is provided essentially by the base body.

The base body may be configured as a metal block. Therefore, the sealing element is configured to be heat resistant and to have dimensional stability. In addition, the sealing element also has a great mechanical load bearing capacity.

As an alternative, the base body may be configured as a spring plate. Therefore, the sealing element may be manufactured easily and cost effectively. In addition, with a suitable configuration of the sealing element, the base body configured as a spring plate may be under prestress.

The base body may have a sleeve at the ends of which a collar is formed. This may provide a support of the base body over the collars on the fuel injector and on a step of the receiving bore.

The sealing element may be partially in contact with the second contact surface of the base body. The sealing element of the seal may therefore assume the function of axial sealing as well as the function of radial sealing.

The sealing element may be made of a heat-resistant plastic, e.g., a fluoroelastomer or a fluoroelastomer based on a vinylidine fluoride-hexafluoro-propylene copolymer. The sealing element may be bonded to the base body by vulcanization. The sealing element may be manufactured as follows, for example. First, the starting plastic material, e.g., in the form of a powder or granules, is applied to the base body, and then the starting plastic material is vulcanized, forming a heat-resistant plastic which adheres to the base body. The surface of the base body may be prepared accordingly, e.g., by roughening.

The sealing element may be made of polytetrafluoroethylene (PTFE). This creates a heat-resistant sealing element which is simple to manufacture and is resistant to combustion gases because of its extremely high resistance to chemicals.

The sealing element may be under prestress in the axial direction by way of the base body in the installed state of the fuel injector. Therefore, it is possible to further improve on sealing with this sealing element, in particular in the radial direction.

The base body may be in contact with the step of the receiving bore by way of a sealing sheet. The sealing sheet may be made of a soft metal, e.g., copper. This permits a further improvement in the seal. In addition, the sealing element is protected by the sealing sheet from direct contact with the hot combustion gases and the temperature of the combustion gases.

The housing part may be arranged on the side of the fuel injector facing away from the fastening element. Therefore, the fastening partial ring may surround the fuel injector on two sides, providing a good transfer force from the fastening element to the fuel injector.

The fastening partial ring may have a peripheral inner shoulder which works together with a peripheral shoulder on the fuel injector to prevent tilting of the fuel injector. Therefore, the force of the holding-down clamp is transmitted at least almost uniformly to the fuel injector around the perimeter.

The fastening partial ring may have an inside surface with which the fuel injector is at least essentially in surface contact to prevent displacement of the fuel injector in a radial direction. Due to the surface contact of the fuel injector with the inside surface of the fastening partial ring, tilting of the fuel injector is also prevented.

The base body may be configured so that the sealing element is close to the tip of the valve. This permits a reduction in the dead volume or the HC pockets.

The base body may function as a heat sink to dissipate the heat from the fuel injector, e.g., in the area of the nozzle body.

The base body may be mounted in contact with the cylinder head to further improve cooling of the valve body.

The holding-down clamp may be arranged at least partially in the receiving bore, and the inside surface of the holding-down clamp is essentially in contact with the fuel injector in an area within the receiving bore. The holding-down clamp may therefore be countersunk at least partially into the receiving bore of the cylinder head, so that the fuel injector may have a more compact configuration. In addition, this facilitates assembly and permits better protection of the holding-down clamp.

DETAILED DESCRIPTION

Figure 1:
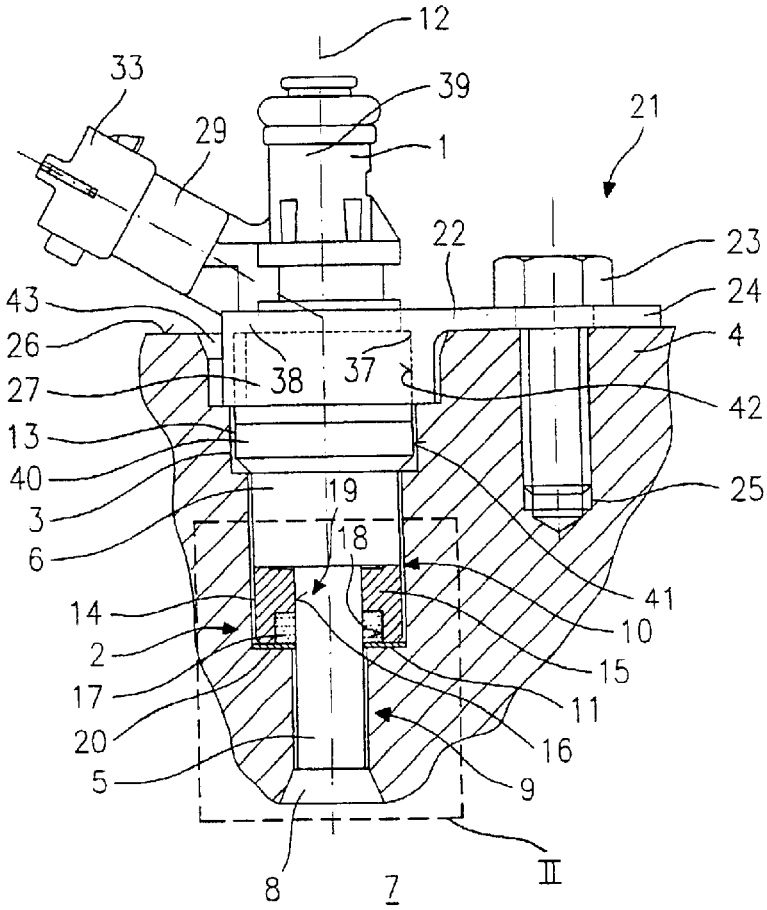
FIG. 1 illustrates a detail of an axial section through a first example embodiment in which a fuel injector is secured in a receiving bore of a cylinder head via a sealing element according to the present invention and a holding-down clamp according to the present invention.

FIG. 1 illustrates a fuel injector 1 inserted into a receiving bore 3 in a cylinder head 4 having a sealing element 2 according to a first example embodiment. Fuel injector 1 has a nozzle body 5 connected to a middle part 6 of fuel injector 1. Nozzle body 5 has a fuel nozzle for injecting fuel into a combustion chamber 7 of the internal combustion engine, so that fuel enters combustion chamber 7 through a spray orifice 8 of cylinder head 4 sealing element 2 surrounds nozzle body 5 on the periphery, the outside diameter of sealing element 2 at least essentially corresponding to the outside diameter of middle part 3, and the inside diameter of sealing element 2 corresponding at least essentially to the outside diameter of nozzle body 5. In addition, receiving bore 3 has a first section 9 of a smaller diameter and a second section 10 of a larger diameter. First section 9 and second section 10 are joined by a step 11 of receiving bore 3. The outside diameter of middle part 6 of fuel injector 1 and the outside diameter of sealing element 2 in this example embodiment correspond at least essentially to the diameter of second section 10 of receiving bore 3. The axis of fuel injector 1 in this example embodiment corresponds to axis 12 of receiving bore 3. To permit displacement of fuel injector 1 in the radial direction, a stepped annular gap 13 is formed between fuel injector 1 and receiving bore 3, including an annular gap 14 formed between middle part 6 of fuel injector 1 or sealing element 2 and second section 10 of receiving bore 3. By displacement of fuel injector 1 in the radial direction, it is possible to achieve an axial offset between the axis of fuel injector 1 and axis 12 of receiving bore 3 to compensate for an axial offset between an axis of a connection piece of a high-pressure fuel line and axis 12 of receiving bore 3.

Sealing element 2 includes a base body 15 having a recess 16 and a sealing element 17 inserted into a recess 18 in base body 15. Recess 16 in base body 15 is configured in this example embodiment as a central axial bore through base body 15, and nozzle body 5 extends through recess 16. Recess 18 communicates with recess 16, resulting in a stepped bore 19.

Sealing element 2 is supported on step 11 of receiving bore 3 via a sealing sheet 20. In addition, sealing element 2 is also supported on central part 6.

Fuel injector 1 is held in receiving bore 3 by a holding-down device 21. Holding-down device 21 has a holding-down clamp 22 and a fastening element configured as a screw 23. Screw 23 passes through a lever arm 24 of holding-down clamp 22 and is screwed into a threaded bore 25 in cylinder head 4. In this example embodiment, screw 23 is screwed completely into threaded bore 25 so that lever arm 24 is in planar contact with top side 26 of cylinder head 4.

Holding-down clamp 22 has a fastening partial ring 27 connected to lever arm 24, partially surrounding fuel injector 1. Fastening partial ring 27 of holding-down clamp 22 has a recess 28 (FIG. 4) into which is inserted a housing part 29 of fuel injector 1 to prevent twisting of the fuel injector, because due to contact of housing part 29 with surfaces 31, 32 (FIG. 4), rotation of fuel injector 1 about the axis of fuel injector 1, which in this example embodiment corresponds to axis 12 of receiving bore 3, is blocked, so the rotational position of fuel injector 1 is predetermined at the same time. Housing part 29 includes an electric plug connector 33.

Fuel injector 1 has a shoulder 37 which is acted upon by a peripheral internal collar 38 of fastening partial ring 27 of holding-down clamp 22. The force of the prestress created by the tightening force of screw 23 is transmitted uniformly at the circumference to shoulder 37 of fuel injector 1 via peripheral internal collar 38 so that a uniform force acting on fuel injector 1 is achieved to prevent tilting of fuel injector 1. To achieve good lever ratios, recess 28 (FIG. 4) is arranged on the side of fastening partial ring 27 facing away from lever arm 24 of holding-down clamp 22. Fuel injector 1 therefore has a rotational angular position in receiving bore 3 of cylinder head 4 with respect to the axis of fuel injector 1 at which the angular position of housing part 29 is offset by 180° with respect to the angular position of screw 23 or lever arm 24.

Fuel injector 1 has a fuel inlet connection 39 through which fuel is conveyed to nozzle body 5 from a high-pressure fuel line into fuel injector 1. Fuel inlet connection 39 is connected to a housing part 40 on which a shoulder 37 is formed. Housing part 40 has an outside surface 41. An inside surface 42 of fastening partial ring 27 of holding-down clamp 22 is in contact with outside surface 41 of housing part 40 of fuel injector 1. Inside surface 42 is thus at least essentially in surface contact with the outside surface 41 in some areas, thus preventing displacement of fuel injector 1 in the radial direction and securing the axial position of fuel injector 1. Fastening partial ring 27 is at least partially arranged in a recess 43 which is part of receiving bore 3, so that fastening partial ring 27 is partially countersunk in cylinder head 4.

Figure 2:
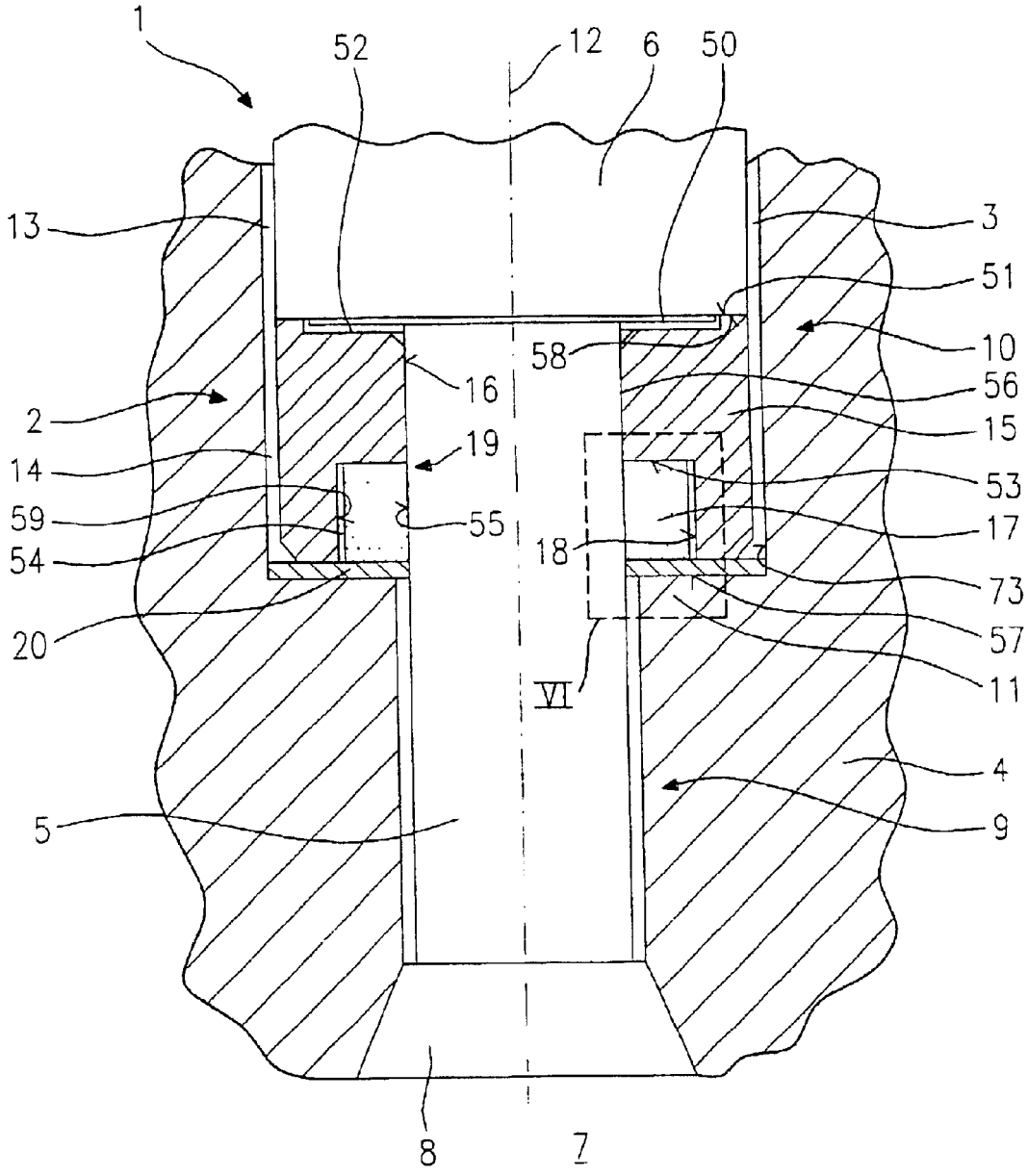
FIG. 2 illustrates the detail labeled as II in FIG. 1.

FIG. 2 illustrates the detail labeled as II in FIG. 1. Elements that have already been described are labeled with the same reference numbers, eliminating the need for a repetition of the description.

Fuel injector 1 has a step 50 connecting center part 6 to nozzle body 5. Base body 15 of sealing element 2 is in contact with a first end contact face 51 on center part 6 of fuel injector 1, having a recess 52 which accommodates step 50. Base body 15 has a recess 16 configured as an axial bore through which nozzle body 5 extends. In addition, base body 15 has a recess 18 which is connected to recess 16, thus forming step bore 19 of base body 15. In this example embodiment, the height of recess 18 in the axial direction is approximately equal to half the height of base body 15 in the axial direction. The width of recess 18 in the radial direction in this example embodiment is approximately equal to half the width of the cross section of base body 15 in the radial direction. Recess 18 therefore has a rectangular cross-section.

Sealing element 17 is introduced into recess 18 of base body 15, sealing element 17 being in contact with an axial surface 53 of base body 15, and an annular gap 54 is formed between sealing element 17 and radial surface 59 of base body 15. The inside diameter of sealing element 17 is smaller than the outside diameter of nozzle body 5 in the relaxed state, so that a prestress acts upon sealing element 17. The prestress of sealing element 17 acts on a sealing face 55 on nozzle body 5, thus sealing a gap 56 formed between base body 15 and nozzle body 5. Sealing element 17 may be introduced especially easily into recess 18 of base body 15 through annular gap 54 because there is no friction between base body 15 and sealing element 17 in such a procedure.

Base body 15 is supported on step 11 of receiving bore 3 of cylinder head 4 via sealing sheet 20. In the installed state of fuel injector 1, base body 15 is acted upon by an axial prestress force by way of hold-down device 21 (FIG. 1) so that annular gap 14 is sealed by sealing sheet 20. Sealing sheet 20 may be made of a soft metal, e.g., copper, so that sealing element 17 is protected from direct contact with combustion gases. Protection is provided against both chemical and thermal effects of the combustion gases on sealing element 17. In this example embodiment, sealing sheet 20 is in contact with nozzle body 15 as well as a peripheral wall 73 of receiving bore 3. Therefore, the position of nozzle body 5 in the area of sealing sheet 20 is predetermined. The outside diameter and/or the inside diameter of sealing sheet 20 may also be selected so that an intermediate space is formed between nozzle body 5 and sealing sheet 20 or sealing sheet 20 and peripheral wall 73 of receiving bore 3, thus permitting displacement of fuel injector 1 in the radial direction.

Sealing element 17 may be made of polytetrafluoroethylene (PTFE). Polytetrafluoroethylene may have the advantage that it has thermal stability and an extremely high resistance to chemicals. Therefore, a sealing sheet 20 may also be eliminated if sealing element 17 is made of polytetrafluoroethylene or a similar material. In addition, heating of polytetrafluoroethylene results in a reversible increase in volume, so that sealing element 17 may be applied to nozzle body 5 of fuel injector 1 with some play, so that sealing element 17 is heated during operation and sealing surface 55 is sealed because of the increase in volume. An equalization space is created by gap 54 between base body 15 and sealing element 17 to prevent damage to nozzle body 5 in the event of an increase in volume.

Sealing element 17 may also be made of another material which has appropriate thermal stability and resistance to chemicals.

At a first contact surface 51, base body 15 is in contact with an end face 58 of step 50 of fuel injector 1, and at a second contact surface 57 which is opposite first contact surface 51, it is in contact with step 11 of receiving bore 3 via sealing sheet 20, so the distance between end face 58 of fuel injector 1 and step 11 is determined by the height of base body 15 and the thickness of sealing sheet 20. Therefore, the prestress force of fuel injector 1 may also be determined by the height of base body 15 and/or by the thickness of sealing sheet 20. First contact face 51 extends parallel to second contact face 57, so this may yield a transfer of force of the prestress force of fuel injector 1 to sealing sheet 20. Base body 15 may be configured as a metal block to transfer the force of the prestress to sealing sheet 20 without any mentionable deformation.

Figure 3:
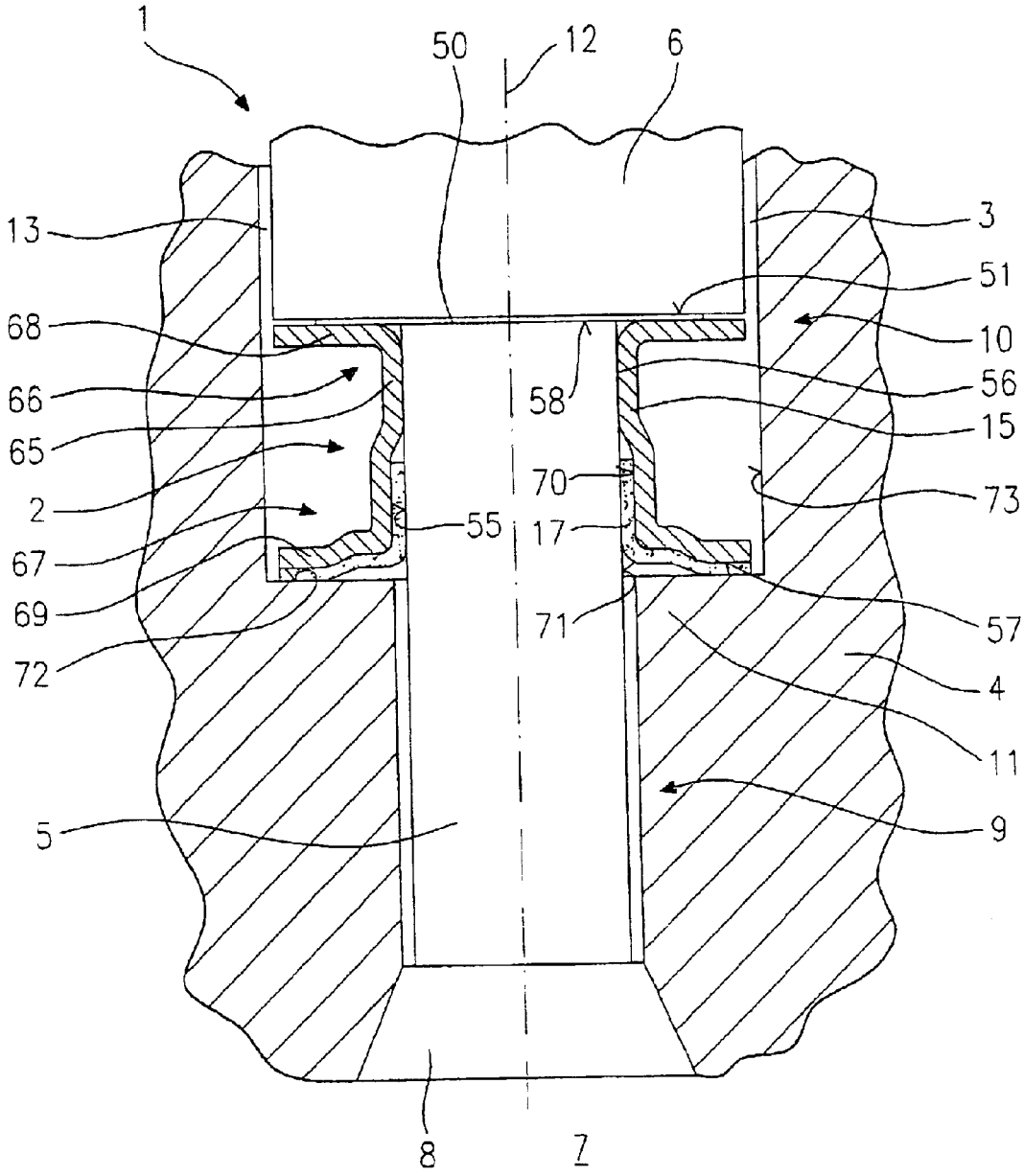
FIG. 3 illustrates the detail labeled as II in FIG. 1 in an alternative arrangement according to a second example embodiment.

FIG. 3 illustrates the detail labeled as II in FIG. 1 in an alternative arrangement according to a second example embodiment of a sealing element 2 according to the present invention. Elements that have already been described are labeled with the same reference numbers so no repetition of the description is necessary.

In this example embodiment, base body 15 has a sleeve 65 which is bent at its ends 66, 67, so that a collar 68 projecting radially outward is formed on end 66, and a collar 69 projecting radially outward is formed on end 67. Collar 68 on end 66 of base body 15 has a first contact face 51 which is in contact with step 50. The contact occurs on an end face 58 of step 50 of fuel injector 1. Collar 69 of base body 15 has a second contact face 57 which is connected to sealing element 17. Sealing element 17 is also connected to an internal contact face 70 which is formed on base body 15 opposite a lateral surface 71 of nozzle body 15. Sealing element 17 therefore forms sealing face 55 with nozzle body 5 as well as sealing face 72 with step 11. Sheet 20 may therefore be omitted from the first example embodiment illustrated in FIGS. 1 and 2.

The connection of sealing element 17 to base body 15 is obtained due to the fact that sealing element 17 is vulcanized onto base body 15. In the manufacture of sealing element 2, vinylidine fluoride-hexafluoropropylene copolymers are applied to base body 15 and then vulcanized, thus producing the corresponding fluoroelastomer. After production of sealing element 17 by vulcanization, the resulting fluoroelastomer adheres to metallic base body 15. Therefore, sealing element 2 is made of one piece, thus simplifying its application to nozzle body 5 and assembly of fuel injector 1.

In both example embodiments, sealing element 2 is sealed on nozzle body 5 in the radial direction and on step 11 of receiving bore 3 in the axial direction. Since there is no sealing radially against wall 73 of receiving bore 3, when sealing element 2 is introduced into receiving bore 3, there is also no frictional force which would occur due to contact of sealing element 2 with wall 73, thus greatly simplifying the installation and removal of fuel injector 1. In addition, sealing element 2 reliably seals receiving bore 3 so that a stepped annular gap 13 may be formed, permitting radial displacement of fuel injector 1 so that an offset of axis 12 of receiving bore 3 and an axis of a connection piece of a high-pressure fuel line may be compensated.

Therefore, base body 15 may be configured as a spring plate, so it undergoes elastic deformation under an axial load.

Figure 4:
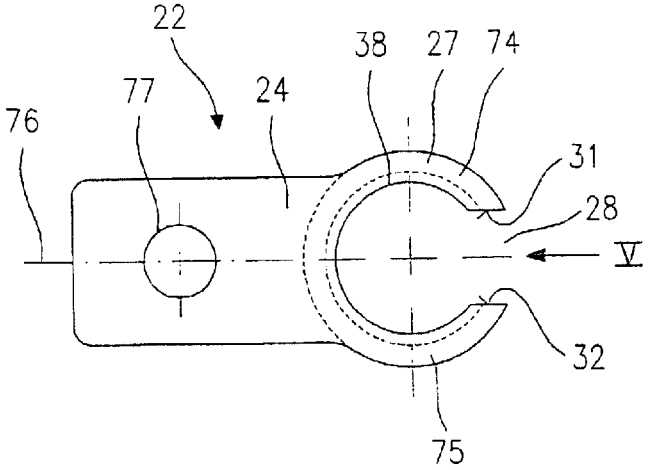
FIG. 4 illustrates a top view of a holding-down clamp according to the present invention.

FIG. 4 illustrates holding-down clamp 22 illustrated in FIG. 1 in a top view. Holding-down clamp 22 has a lever arm 24 and a fastening partial ring 27 joined to one another. Fastening partial ring 27 is interrupted by a recess 2B, forming a first partial circular section 74 and a second partial circular section 75. First partial circular section 74 has a face 31 opposite a face 32 formed on second partial circular section 75. Fastening partial ring 27 has a peripheral internal collar 38 which is also interrupted by recess 28. The two faces 31, 32 are arranged in parallel to one another, axis of symmetry 76 of holding-down clamp 22 being parallel to that of faces 31, 32.

The function of fastening partial ring 27 is to fasten fuel injector 1 in receiving bore 3, faces 31, 32 being in contact with a housing part 29 of fuel injector 1 to prevent twisting of fuel injector 1. Peripheral internal collar 38 cooperates with shoulder 37 of fuel injector 1 to achieve a uniform transfer of a holding force of holding-down clamp 22 to fuel injector 1.

Lever arm 24 of holding-down clamp 22 has a bore 77 to permit fastening of holding-down clamp 22 in threaded bore 25 of cylinder head 4 by screw 23 (FIG. 1).

Figure 5:
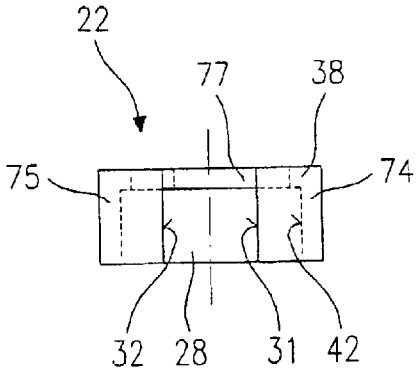
FIG. 5 is a side view of the holding-down clamp illustrated in FIG. 4 in the direction labeled as V.

FIG. 5 is a front view of holding-down clamp 22 illustrated in FIG. 4 from the direction labeled as V in FIG. 4. Elements already described above are labeled here with the same reference notation.

Fastening partial ring 27 has inside face 42 which in the installed state is in contact with the housing of fuel injector 1 to further secure the axial position of fuel injector 1.

Therefore, even with a stepped annular gap 13 (FIG. 1) which permits displacement and tilting of the axis of fuel injector 1 toward axis 12 of receiving bore 3, the axial position of fuel injector 1 may be secured by holding-down clamp 22. Fuel injector 1 may not be secured rigidly in receiving bore 3 in the radial direction by sealing element 2 according to the present invention. Therefore, a sealing element 2 according to the present invention may be used together with a holding-down clamp 22 according to the present invention for securing a fuel injector 1 in a receiving bore 3. However, sealing element 2 according to the present invention and holding-down clamp 22 according to the present invention may also be used independently of one another. In addition, sealing element 2 according to the present invention and holding-down clamp 22 according to the present invention are also suitable for other applications. Furthermore, sealing sheet 20 (FIG. 1) may also be replaced by a sealing body having a different configuration.

Figure 6:
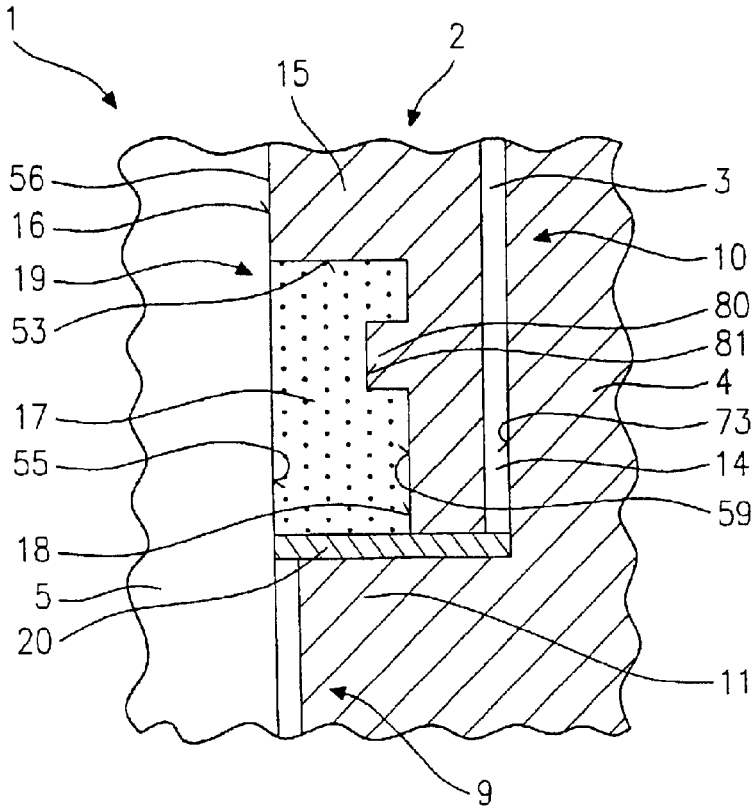
FIG. 6 illustrates the detail labeled as VI in FIG. 2 in an alternative arrangement according to a third example embodiment.

FIG. 6 illustrates the detail labeled as VI in FIG. 2 in an alternative arrangement according to a third example embodiment of a sealing element 2 according to the present invention. Elements described previously are labeled with the same reference notation so it is not necessary to repeat the description here.

In this example embodiment, sealing element 17 arranged in a ring arrangement around nozzle body 5 is joined to base body 15 by a nose-like projection 80 of base body 15 in a friction-locked manner. Sealing element 17 has a recess 81 with which projection 80 of base body 15 engages for this purpose. Sealing element 2 according to the third example embodiment may provide that the position of sealing element 17 of sealing element 2 is secured at the time of assembly of sealing element 2. In addition, sealing element 17, which has at least partially entered into a bond with nozzle body 5 or sealing sheet 20 or step 11 (if sheet 20 is not provided) is prevented from being separated from base body 15 during dismantling of sealing element 2, which may be necessary due to maintenance work, for example.

Figure 7:
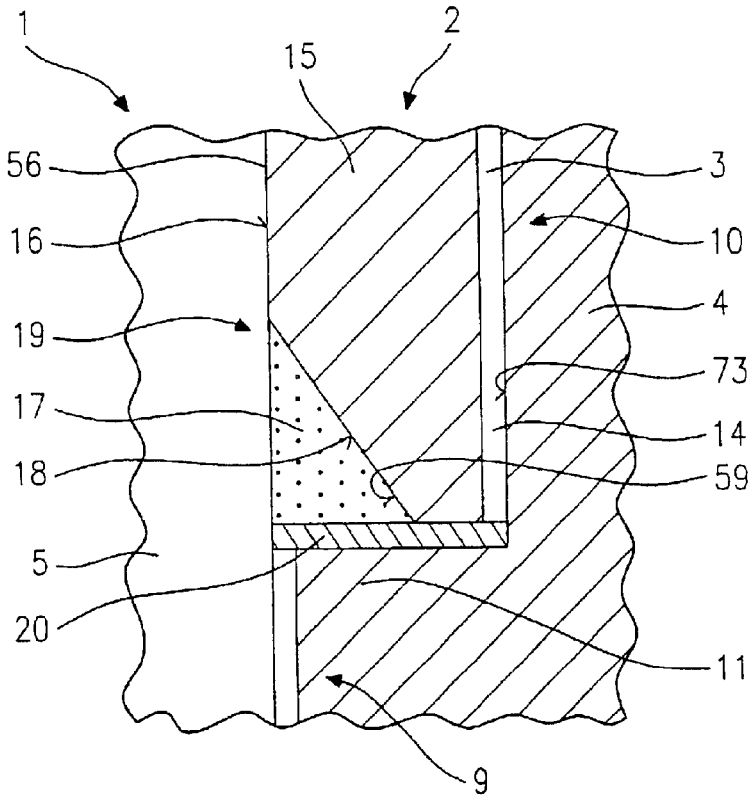
FIG. 7 illustrates the detail labeled as VI in FIG. 2 in an alternative arrangement according to a fourth example embodiment.

FIG. 7 illustrates the detail labeled as VI in FIG. 2 in an alternative arrangement according to a fourth example embodiment.

In this example embodiment, recess 18 of base body 15 is configured so that starting from a location between first contact face 51 and second contact face 57 (FIG. 3), it widens monotonically starting from a diameter defined by recess 16 up to a diameter which may be smaller than the outside diameter of base body 15, so that recess 18 has a triangular cross-section. An annular sealing element 17 is introduced into recess 18 and has a triangular cross-section corresponding to that of recess 18. As a result of radial face 59, which is inclined with respect to axis 12 due to the sealing element 2 being acted upon by an axial prestress, the sealing force with which sealing element 17 is pressed against nozzle body 5 to seal gap 56 may be increased by sealing element 2 according to the fourth example embodiment. Due to the opening angle of recess 18, which determines the inclination of radial face 59 toward axis 12, the size of the sealing forces with which gap 56 and gap 14 are sealed may be adjusted. Recess 18 may optionally also includes multiple inclined sections having different opening angles at least in part.

Figure 8:
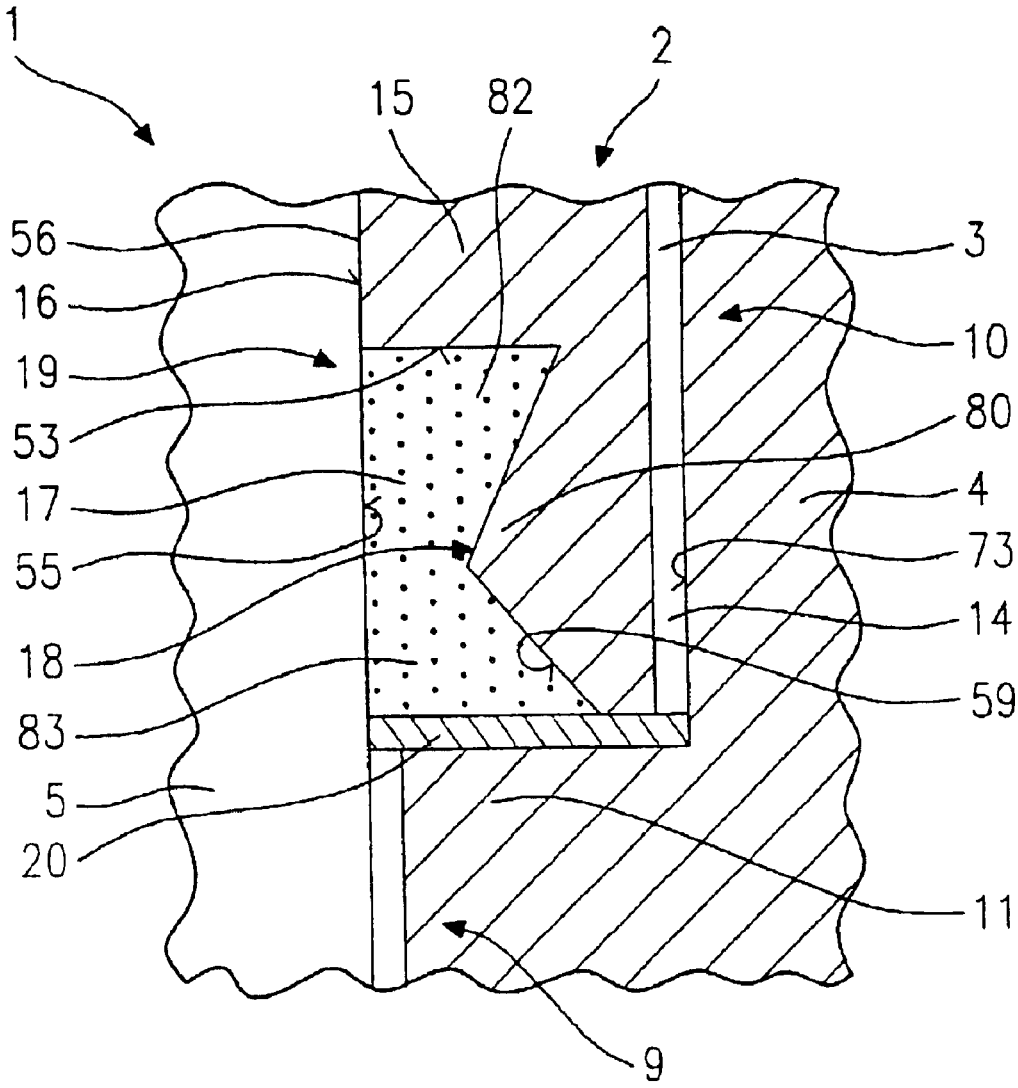
FIG. 8 illustrates the detail labeled as VI in FIG. 2 in an alternative arrangement according to a fifth example embodiment.

FIG. 8 illustrates the detail labeled as VI in FIG. 2 in an alternative arrangement according to a fifth example embodiment of a sealing element 2 according to the present invention.

Recess 18 of base body 15 according to the fifth example embodiment has a first part 82 and a second part 83. Second part 83 is configured like recess 18 according to the fourth example embodiment (see FIG. 7), second part 83 of recess 18 in this case becomes larger, starting at a diameter greater than the diameter of nozzle body S. First part 82 of recess 18 becomes narrower continuously, starting from axial face 53 of base body 15 having a diameter greater than the diameter beyond which second part 83 of recess 18 becomes larger up to this diameter. Sealing element 17 is shaped so that it is inserted into recess 18, resulting in a friction-locked connection with base body 15 of sealing element 2 due to projection 80 formed on base body 15 similar to the connection according to the third example embodiment (see FIG. 6).

The arrangements of sealing element 2 described in the example embodiments should be understood as examples of arrangements characterized by their simplicity. By combining and modifying these example embodiments, sealing element adapted to different boundary conditions may be formed.

What is claimed is:

1. A sealing element for a fuel injector insertable into a receiving bore of a cylinder head of an internal combustion engine for direct injection of fuel into a combustion chamber of the internal combustion engine, comprising:

a base body having an axial recess and an annular recess, the axial recess configured to receive a nozzle body of the fuel injector therethrough, the annular recess in communication with the axial recess; and a sealing arrangement arranged in the annular recess and configured to surround the nozzle body peripherally;

wherein a first contact face of the base body is arranged in at least indirect contact with an end face of the fuel injector and a second contact face arranged opposite the first contact face of the base body is arranged in at least indirect contact with a step of the receiving bore.

2. The sealing element according to claim 1, wherein an axial height of the annular recess is at least essentially equal to half an axial height of the base body.

3. The sealing element according to claim 1, wherein a radial width of the annular recess is at least essentially equal to half a radial width of a cross-section of the base body in an area of the annular recess.

4. The sealing element according to claim 1, wherein the annular recess includes an essentially rectangular cross section.

5. The sealing element according to claim 1, wherein the annular recess is arranged increasingly wider toward the second contact face.

6. The sealing element according to claim 5, wherein a cross-section of the annular recess includes an essentially triangular cross-section.

7. The sealing element according to claim 1, wherein the base body includes a metal block.

8. The sealing element according to claim 1, wherein the base body includes a spring plate.

9. The sealing element according to claim 8, wherein the base body includes a sleeve, each end of the sleeve including a collar.

10. The sealing element according to claim 1, wherein the sealing arrangement includes a sealing ring.

11. The sealing element according to claim 1, wherein the sealing arrangement is arranged in partial contact with the second contact face of the base body.

12. The sealing element according to claim 1, wherein the sealing arrangement includes a heat-resistant plastic.

13. The sealing element according to claim 12, wherein the heat-resistant plastic includes a fluoroelastomer.

14. The sealing element according to claim 13, wherein the heat-resistant plastic includes a fluoroelastomer based on vinylidine fluoridehexafluoropropylene copolymers.

15. The sealing element according to claim 12, wherein the sealing arrangement is bonded to the base body by vulcanization.

16. The sealing element according to claim 1, wherein the sealing arrangement includes polytetrafluoroethylene.

17. The sealing element according to claim 1, wherein the sealing arrangement is under prestress in a radial direction.

18. The sealing element according to claim 1, wherein the sealing arrangement is under prestress in an axial direction by the base body in an installed state of the fuel injector.

19. The sealing element according to claim 1, wherein the base body is in contact with the step of the receiving bore by way of a sealing sheet.

20. The sealing element according to claim 19, wherein the sealing sheet includes a soft metal.

21. The sealing element according to claim 20, wherein the soft metal includes copper.

* * * * *

UNITED STATES PATENT AND TRADEMARK OFFICE

CERTIFICATE OF CORRECTION

PATENT NO. : 6,811,102 B2
APPLICATION NO. : 10/048671
DATED : November 2, 2004
INVENTOR(S) : Heinz-Martin Kraus et al.

It is certified that error appears in the above-identified patent and that said Letters Patent is hereby corrected as shown below:

On the face of the patent, # (57) Abstract, lines 1-4, delete "(2) (1) (3) (4) (7)"

On the face of the patent, # (57) Abstract, line 4, change "engine has a" to --engine includes a--

On the face of the patent # (57) Abstract, lines 5-14, delete "(17) (5) (4) (2) (15) (16) (5) (15) (18) (16) (17) (51) (15) (58) (1) (57) (51) (15)"

On the face of the patent # (57) Abstract, line 15, change "the step (11) of the receiving bore (3)." to --a step of the receiving bore--

Column 4, line 60, change "cylinder head 4 sealing element 2" to --cylinder head 4. Sealing element 2--

Signed and Sealed this

Fourteenth Day of July, 2009

John Doll

JOHN DOLL
*Acting Director of the United States Patent and Trademark Office*